US007036758B2

(12) United States Patent
Hamada et al.

(10) Patent No.: US 7,036,758 B2
(45) Date of Patent: May 2, 2006

(54) CONE CRUSHER

(75) Inventors: Takeshi Hamada, Kobe (JP); Masaki Hamaguchi, Takasago (JP); Shoji Inomata, Takasago (JP); Hirotoshi Takanami, Takasago (JP); Hiroyuki Yuki, Takasago (JP)

(73) Assignee: Kabushiki Kaisha Kobe Seiko Sho (Kobe Steel, Ltd.), Kobe (JP)

( * ) Notice: Subject to any disclaimer, the term of this patent is extended or adjusted under 35 U.S.C. 154(b) by 33 days.

(21) Appl. No.: 10/624,638

(22) Filed: Jul. 23, 2003

(65) Prior Publication Data

US 2004/0159728 A1 Aug. 19, 2004

(30) Foreign Application Priority Data

Jul. 29, 2002 (JP) ..... 2002-219974

(51) Int. Cl.
*B02C 2/06* (2006.01)

(52) U.S. Cl. ..... 241/209; 241/207; 241/208; 241/214; 241/215; 241/216; 241/293

(58) Field of Classification Search ..... 241/207–16, 241/293
See application file for complete search history.

(56) References Cited

U.S. PATENT DOCUMENTS 3,477,651 A 11/1969 Decker et al.
4,165,043 A 8/1979 Higashi et al.
4,339,087 A * 7/1982 Pollak ..... 241/211
4,787,563 A 11/1988 Tanaka et al.
5,779,166 A * 7/1998 Ruokonen et al. ..... 241/213
6,581,860 B1 * 6/2003 Savolainen ..... 241/101.3

FOREIGN PATENT DOCUMENTS

| | | |
|---|---|---|
| DE | 25 42 660 | 3/1977 |
| EP | 0 567 077 | 10/1993 |
| WO | WO 01/58594 | 8/2001 |

* cited by examiner

*Primary Examiner*—Derris H. Banks
*Assistant Examiner*—Jason Y. Pahng
(74) *Attorney, Agent, or Firm*—Oblon, Spivak, McClelland, Maier & Neustadt, P.C.

(57) ABSTRACT

A crushing chamber is formed between a concave liner and a mantle liner. The concave liner has a first area surface having a length of T to $\sqrt{2}T$; a second and a third area surface; which surfaces are gradually inclined from the side of the inlet for the crushing chamber. The mantle liner has a first tapered surface having a length of greater than T, a cross angle of less than 20° and an inclination angle of greater than 60°; a second tapered surface having a length of greater than 0.5T and a cross angle of 5° to 10°; and a third tapered surface having an inclination angle of 45° to 50°. The area surfaces as well as the tapered surfaces are continuously arranged in a curvilinear manner. The shapes enhance the throughput of goods in a good fine-crushing performance, reducing the uneven abrasion due to the action.

12 Claims, 9 Drawing Sheets

DIAGRAM SHOWING THE RELATIONSHIP BETWEEN AN APPLIED LOAD AND THE DISPLACEMENT IN THE SINGLE PARTICLE FRACTURE

CONE CRUSHER

BACKGROUND OF THE INVENTION

1. Field of the Invention

The present invention relates to a concave liner and a mantle liner in a cone crusher, which is used to produce coarse aggregate and fine aggregate for concrete, asphalt-ply material or the like.

2. Description of the Related Art

A conventional cone crusher is equipped with a stationary concave liner and a mantle liner fixed to a mounting base as a movable member which is capable of approaching the inner periphery of the concave liner and separates therefrom, and a crushing chamber is formed between the concave liner and the mantle liner, so that a material to be crushed, i.e., a crush material, is crushed in the crushing chamber, thereby enabling predetermined products to be obtained. Therefore, such liners for the cone crusher was basically designed on the basis of combining the shapes of the concave liner with that of the mantle liner, which liners form a crusher chamber providing the most favorable crushing action. The performance of crushing is specified by the throughput of products, the fine crushing performance named the crushing ratio (the size of the raw material/the size of products), the electric power consumption, the mechanical vibration, and others.

As for the above-mentioned performance of crushing, it is assumed that an increased inclination of a mantle liner provides an increased throughput of products. However, this causes the speed of moving the crush material to be increased, so that the fine-crushing performance is deteriorated. On the other hand, a decreased inclination of the mantle liner causes the speed of moving the crush material to be decreased, so that fine goods can be obtained. However, this causes the crush material to be clogged up, thereby enabling the electric power consumption and the mechanical vibration to be increased. Taking such conditions into account, various shapes for the concave liner and the mantle liner have been proposed to realize an optimal shape of the crushing chamber having an enhanced crushing performance.

Nevertheless, even if such a crushing camber having an optimal shape is formed, taking the above-mentioned conditions into account, paired upper and lower liners are selectively worn away in an increased period of operation (partial abrasion) to provide an extremely partial uneven shape for these liners, so that the shape of the crushing chamber becomes extremely different from the initially designed shape (in the state of new liners). Accordingly, there is a problem that the crushing performance is more rapidly deteriorated. When, moreover, the crushing performance is deteriorated due to the partial abrasion, the worn liner is exchanged for a new liner, after pausing the operation. In this case, the uneven abrasion provides both extremely strongly worn portions and relatively weakly worn portions to be generated, and therefore there is a problem that the exchange of the old liner for the new liner is uneconomic.

SUMMARY OF THE INVENTION

In view of the above-mentioned problems, it is an object of the present invention to provide a cone crusher, which is equipped with paired upper and lower liners, whose shapes ensure to reduce the uneven abrasion due to the crushing action as well as to increase the throughput of products, maintaining a good fine-crushing performance.

A cone crusher according to the present invention solves the above-mentioned problems. The cone crasher comprises a stationary concave liner, a mounting base as a movable element which is capable of approaching the inner periphery of the concave liner and separating therefrom and a mantle liner fixed to the mounting base, wherein a crush material is crushed in a crushing chamber formed between the concave liner and the mantle liner. The concave liner comprises a first area surface which has a length of T to $\sqrt{2}T$ where T is a predetermined value and faces the crushing chamber to form a first area, a second area surface which extends inclining outward and faces the crushing chamber to form a second area and a third area surface which extends inclining further outward and faces the crushing chamber to form a third area, whereby the first to third area surfaces are sequentially arranged from the inlet of said crushing chamber. And the mantle liner comprises a first tapered surface which has a length of a perpendicular from the first area surface at the end on the inlet side thereto being greater than T, a cross angle of less than 20° with respect to the first area surface, and an inclination angle of greater than 60°, a second tapered surface which has a length of a perpendicular from the second area surface at the end on the inlet side being greater than 0.5T and a cross angle of 5° to 10° with respect to the second area surface and a third tapered surface which has an inclination angle of 45° to 50°, whereby the first to third tapered surfaces are sequentially arranged from the inlet of said crushing chamber.

T is preferably the size of a charging raw material.

In accordance with the above structural arrangement, the length of the perpendicular between the first tapered surface and the first area surface at the end on the inlet side is greater than T in the first area, so that the crush material having a charging raw material size T can be inserted thereinto, and when the charging raw material size of the crush material is T, the maximum particle size is about $\sqrt{2}T$, so that the first area surface has a length suitable for receiving the crush material as a single particle. Since, moreover, the cross angle between the first tapered surface and the first area surface is less than 20°, the crush material may be well received by the first tapered surface together with the first area surface. Since, furthermore, the inclination angle is greater than 60°, the crush material may be securely transferred to the next stage (the second area). Hence, each particle in the crush material having such a charging raw material size T may be received directly by the concave liner and the mantle liner, and at the same time, a proper crushing due to the single particle compression resulting from the press force between the liners is carried out.

In the second area, moreover, the length of the perpendicular between the second tapered surface and the second area surface at the end on the inlet side is greater than 0.5T, so that the crush material having a predetermined size after crushed by the single particle compression in the first area may be introduced into the second area in a regular manner. Since the cross angle between the second tapered surface and the second area surface is greater than 5°, the size of the second area in the inlet may be secured even when the mantle liner approaches the concave liner. In addition, since the cross angle is less than 10°, the volume of the space of the second area may be reduced and the crush material may be securely received in the second area, thereby enabling the crush material to be effectively crushed. As a result, the crush material having a predetermined size, which crush material is obtained by the crushing in the first area, is stacked between the concave liner and the mantle liner, when these liners are away from each other, and further when changing from the separation state to the approach state, a reduction in the space factor between the particles in the crush material provides the multiple particle contact, thereby making it possible to crush the crush material on the basis of the particle layer compression, where the crushing starts at contact portions between particles.

In the third area, moreover, the particle layer compression crushing is continuously carried out, following that in the second area, and the inclination angle of the third tapered surface is 45° to 50°, so that the crush material may be discharged in the third area at an optimal final traveling speed. As a result, the crush material may be discharged as a high quality product from the outlet of the crushing chamber and a greater amount of the crush material may be discharged without clogging up due to a reduced spacing between particles in the crush material.

As a result, a pair of upper and lower liners may be realized, which liners ensure an enhanced throughput of products under the condition that the uneven abrasion due to the crushing action is reduced in the crushing chamber, maintaining a stable and good fine-crushing performance in a desired particle size.

In the cone crusher, the third tapered surface may have a cross angle of 2° to 3° with respect to said third area surface.

In accordance with the above structural arrangement, neither cracks nor local abrasion due to the generation of an excessive stress may be suppressed at the end of the outlet for discharging the crush material.

In the cone crusher, the second area surface may have a length of T to $\sqrt{2}$T and said third area surface has a length of T/$\sqrt{2}$ to T.

In accordance with the above structural arrangement, the size of the crush material more rapidly arrives at the final product size in the crushing chamber.

In the cone crusher, the first tapered surface may have a length of T/$\sqrt{2}$ to T.

In accordance with the above structural arrangement, the minimum size of the charging raw material size of the crush material, which is crushed in the cone crusher, is assumed to be T/$\sqrt{2}$, and the mantle liner is a movable element, so that the crush material may be crushed after it is received as a single particle in the first area.

In the cone crusher, the second tapered surface may have a length of $\sqrt{2}$T to 2.4T.

In accordance with the above structural arrangement, the mantle liner may be uniformly worn away in the second area, which provides a high crush surface pressure.

In the cone crusher, the third tapered surface may have a length of T to $\sqrt{2}$T.

In accordance with the above structural arrangement, the mantle liner may be uniformly worn away in the third area, which also provides a high crush surface pressure.

In the cone crusher, the curvature radius between the first area surface and the second area surface may be 1.4T to 1.7T.

In accordance with the above structural arrangement, the concave liner may be uniformly worn away in an area where the crush surface pressure increases, changing from the single particle compression crushing in the first area to the particle layer compression crushing in the second area.

In the cone crusher, the curvature radius between the second area surface and the third area surface may be 6.4T to 9.7T.

In accordance with the above structural arrangement, the concave liner may be uniformly worn away over the section from the second area to the third area, where the particle layer compression crushing is carried out.

In the cone crusher, the curvature radius between the first tapered surface and the second tapered surface may be 1.7T to 2.0T.

In accordance with the above structural arrangement, the abrasion due to the crushing is uniformly carried out in the section from the single particle compression crushing changes to the particle layer compression crushing.

In the cone crusher, the curvature radius between the second tapered surface and the third tapered surface may be 13T to 16.3T.

In accordance with the above structural arrangement, the abrasion due to the crushing is uniformly carried out over the section from the second area to the third area where the particle layer compression crushing takes place.

A cone crusher according to another aspect of the present invention comprises a stationary concave liner, a mounting base as a movable element which is capable of approaching the inner periphery of the concave liner and separating therefrom and a mantle liner fixed to the mounting base, wherein a crush material is crushed in a crushing chamber formed between the concave liner and the mantle liner. The crushing chamber comprises a first area, wherein the crushing surface of the mantle liner at the inlet for the crush material is 70° to 75° to the horizontal plane and the angle between the crushing surface of the concave liner and the crushing surface of the mantle liner at the inlet is 15° to 20°, a second area, wherein the crushing surface of the mantle liner at a middle part between the inlet and the outlet for the crush material is 52° to 57° to the horizontal plane and the angle between the crushing surface of the concave liner and the crushing surface of the mantle liner at the middle part is 5° to 10° and a third area, wherein the crushing surface of the mantle liner at the outlet for the crush material is 45° to 50° to the horizontal plane and the angle between the crushing surface of the concave liner and the crushing surface of the mantle liner at the outlet is 2° to 3°; whereby the first to third areas are sequentially arranged.

In accordance with the above structural arrangement, the cross angle between the crushing surface of the concave liner and the crushing surface of the mantle liner is less than 20° in the first area, so that the crush material can be well received therein. Furthermore, since the inclination angle to the horizontal plane of the crushing surface of the mantle liner is greater than 70°, the crush material may be securely transferred to the next stage (the second area). As a result, each particle in the crush material may be received directly by the concave liner and the mantle liner, thereby enabling the single particle compression crushing to be well carried out with the press force of these liners.

Since, moreover, the cross angle between the crushing surface of the concave liner and the crushing surface of the mantle liner is greater than 5° in the second area, an adequate dimension of the inlet in the second area may be maintained even when the mantle liner approaches the concave liner. Moreover, the cross angle is less than 10°, the crush material may be securely received in the second area, and further may be effectively crushed. In conjunction with this, since the inclination angle to the horizontal plane of the crushing surface of the mantle liner is greater than 52°, the crush material may be securely transferred to the next stage (the third area). In the second area, therefore, the crush material crushed into a predetermined size in the first area is stacked in a laminar state into the second area, when the mantle liner is away from the concave liner. Furthermore, when changing from the separation state to the approach state, the space factor between the particles in the crush material is reduced and therefore the multiple particle contact takes place, so that the particle layer compression due to the contact points between the particles take place.

Moreover, in the third area, the particle layer compression crushing is carried out, following that in the second area, and the inclination angle to the horizontal plane of the crushing surface of the mantle liner is 45° to 50°, so that the material to be crushed may also be moved at an optimal final traveling speed in the third area. Hence, in the vicinity of the outlet at which the crushed material is discharged from the crushing chamber, a greater amount of crushed particles at a high packaging density may be discharged as a high quality product without clogging up the particle flow.

Accordingly, a pair of upper and lower liners may be realized, which liners ensure an enhanced throughput of products under the condition that the uneven abrasion due to the crushing action is reduced in the crushing chamber, maintaining a stable and good fine-crushing performance in a desired particle size.

In the cone crusher, the crushing surface of the concave liner may be approximately 90° in the first area, 57° to 62° in the second area and 47° to 52° in the third area, to the horizontal plane.

In accordance with the above structural arrangement, the crushing surface of the concave liner is approximately 90° to the horizontal plane in the first area, and therefore the crush material may be securely transferred to the next stage (the second area). In the second area, moreover, the crushing surface of the concave liner is 57° to 62° to the horizontal plane, thereby enabling an adequate size of the inlet in the second area to be maintained even when the mantle liner approaches the concave liner. In conjunction with the above, the crushing surface of the mantle liner is greater than 52° to the horizontal plane, thereby enabling the crush material to be securely transferred to the next stage (the third area). In the third area, moreover, the crushing surface of the concave liner is 47° to 52°, so that the particle layer compression crushing is carried out, following that in the second area.

DESCRIPTION OF THE PREFERRED EMBODIMENTS

Figure 1:
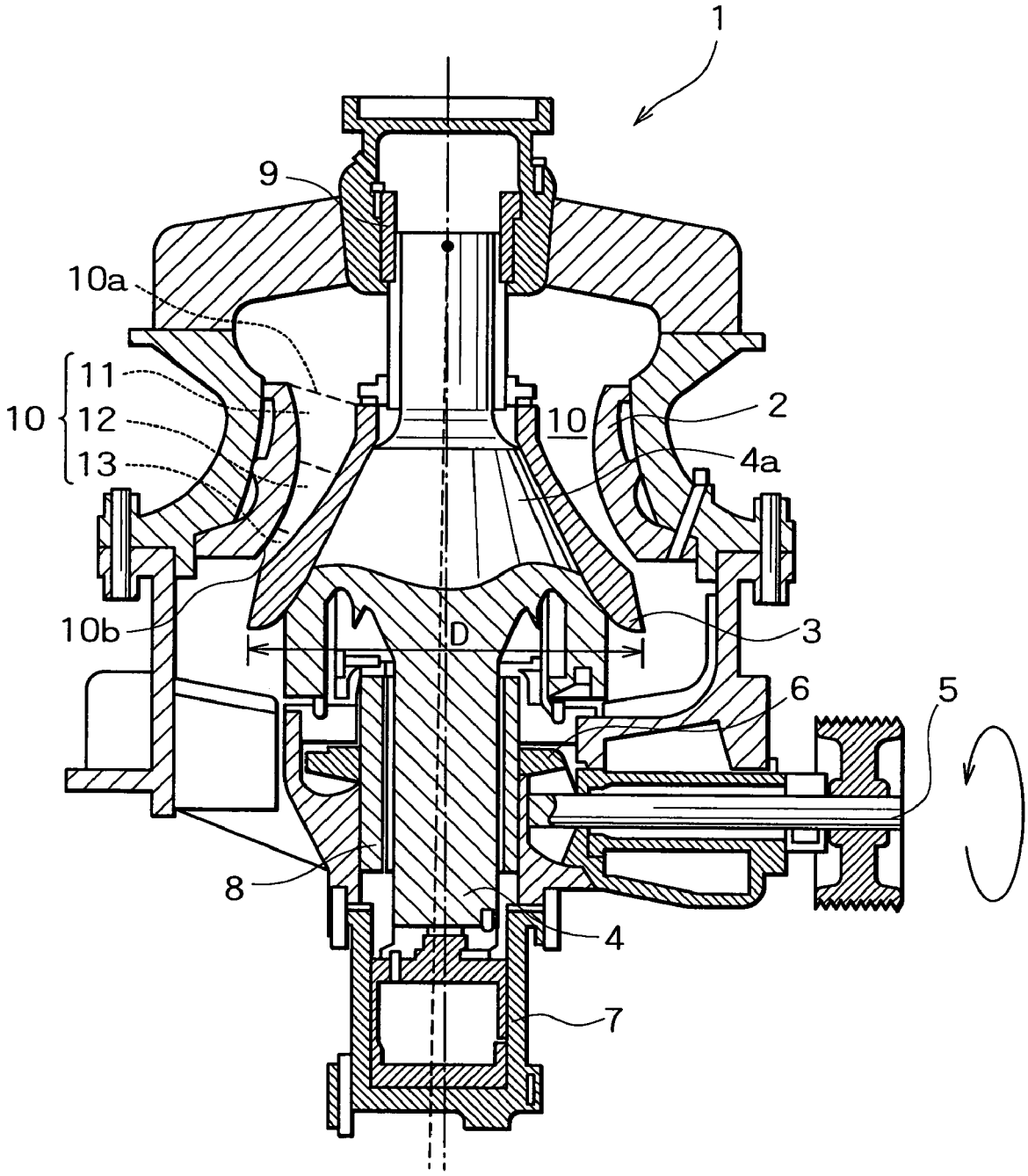
FIG. 1 is a sectional view of a cone crusher according to an embodiment of the invention.

In the following, preferred embodiments of the present invention will be described, referring to FIGS. 1 to 9. FIG. 1 is a sectional view of a cone crusher in an embodiment according to the invention.

In FIG. 1, the cone crusher 1 is equipped with a concave liner 2 and a mantle liner 3, wherein a crushing chamber 10, whose width gradually increases from an inlet 10*a* to an outlet 10*b*, is formed between the liners 2 and 3. The crushing chamber 10 comprises a first region or area 11, a second region or area 12 and a third region or area 13 which are sequentially arranged from the inlet 10*a* to the outlet 10*b*.

The above-described concave liner 2 has an approximately cone shape, and the outer periphery surface thereof is fixed to the main body of the cone crusher 1. At the same time, the inner periphery surface thereof forms the crushing chamber 10. The position of the concave liner 2 is fixed and the height thereof is adjustable.

The above-described mantle liner 3 has an approximately cone shape having the maximum diameter D, and the inner periphery surface thereof is fixed to a mounting base 4*a* and the outer periphery surface forms the crushing chamber 10 together with the concave liner 2. The mounting base 4*a* is disposed at the upper portion of a main shaft 4 as a movable element. The main shaft 4 is inserted into an eccentric mechanism 8 having an approximately cylindrical shape, and the upper end of the main shaft is supported by a bearing 9. Furthermore, a counter shaft 5 is coupled to the eccentric mechanism 8 via a bevel gear 6. The counter shaft 5 is connected to a motor (not shown) via a belt. Moreover, a piston 7 for compensating a variation in the height of the main shaft 4 is disposed at the lower end of the main shaft 4.

In the following, the shape as for both the concave liner 2 and the mantle liner 3 will be described in detail. A crush material 21 having a charging raw material size T is charged in the crushing chamber 10 which is formed between the concave liner 2 and the mantle liner 3. The crush material 21 can be specified by an aspect ratio determined from the maximum size of about $\sqrt{2}T$ and the minimum size of about $T/\sqrt{2}$ when standardizing the charging raw material size T, where 80% of the material passes through a sieve having square holes. Moreover, the shapes for the liners 2 and 3 in the following description are referred to those for new original liners, and therefore the shapes are varied with time due to the crushing of the crush material 21.

The charging raw material size T is the average diameter of the circumscribing sphere of the charging raw material particles.

Figure 2:
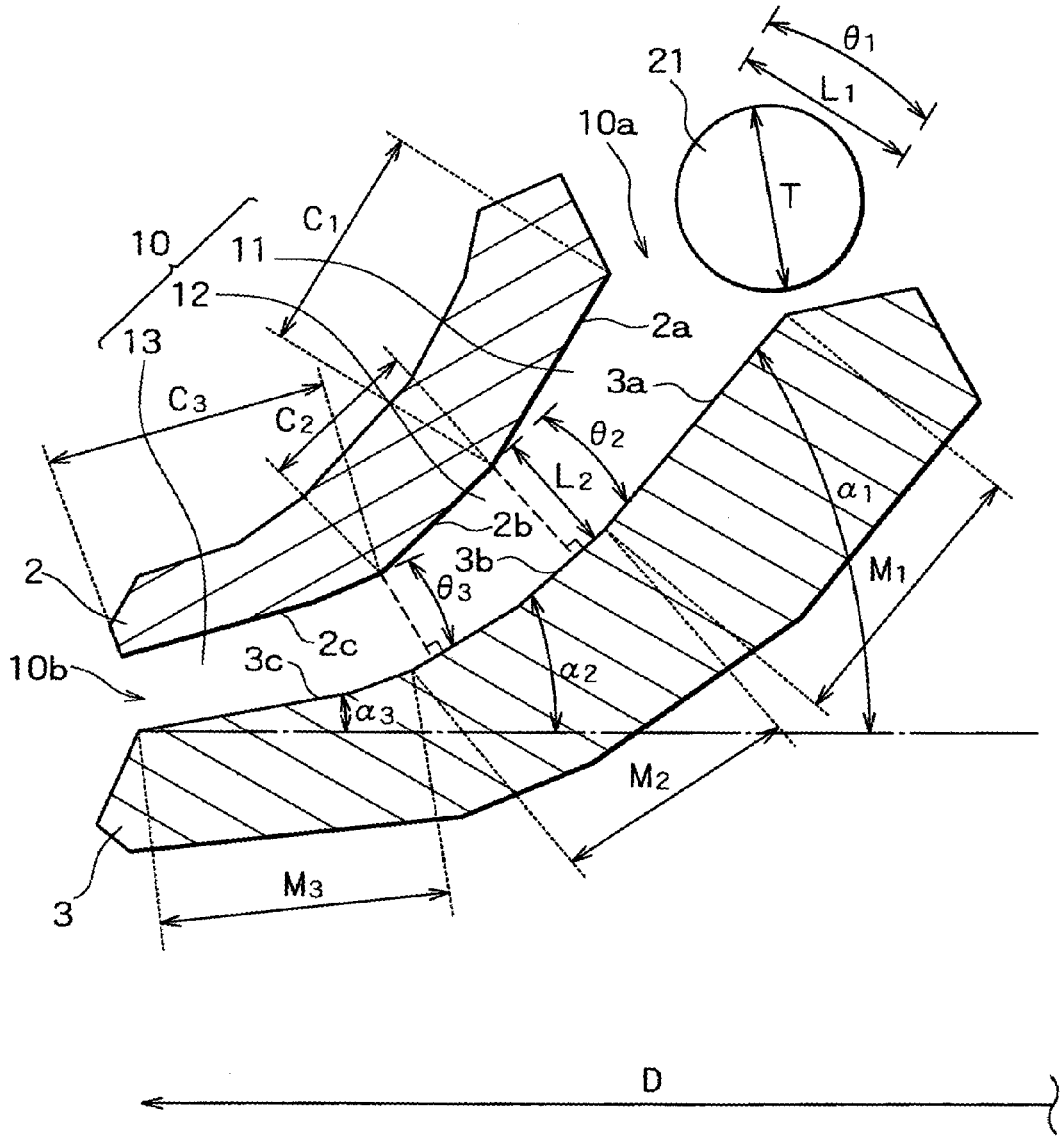
FIG. 2 is a sectional view of a concave liner section and a mantle liner section in FIG. 1.

As shown in FIG. 2, the concave liner 2 comprises a first area surface 2*a* having a length $C_1$ of T to $\sqrt{2}T$; a second area surface 2*b* having a length $C_2$ of T to $\sqrt{2}T$, which surface is inclined from the first area surface 2*a* to the outside thereof; and a third area surface 2*c* having a length $C_3$ of $T/\sqrt{2}$ to T, which surface is inclined from the second area surface 2*b* to the outside thereof; wherein the first to third area surfaces are sequentially arranged from the inlet 10*a* of the crushing chamber 10 in a curvilinear manner.

In conjunction with the above, the mantle liner 3 comprises a first tapered surface 3*a* which has a length $M_1$ of $T/\sqrt{2}$ to T, a cross angle $\theta_1$ of less than 20° with respect to the first area surface 2*a*, and an inclination angle $\alpha_1$ of greater than 60°; a second tapered surface 3*b* which has a length $M_2$ of $\sqrt{2}T$ to 2.4T and a cross angle $\theta_2$ of 5° to 10° with respect to the second area surface 2*b*; and a third tapered surface 3*c* which has a length $M_3$ of T to $\sqrt{2}$T, a cross angle $\theta_3$ of 2° to 3° with respect to the third area surface 2*c*, and an inclination angle $\alpha_3$ of 45° to 50°; wherein the first to third tapered surfaces are sequentially arranged in a curvilinear manner from the inlet 10*a* of the crushing chamber 10. The inclination angle means angle to the horizontal plane.

In the case, the crushing chamber 10 is classified into the first area 11, the second area 12 and the third area 13 by a perpendicular proceeding from the inflection point between the first area surface 2*a* and the second area surface 2*b* onto the second tapered surface 3*b* as well as by another perpendicular proceeding from the inflection point between the second surface area 2*b* and the third surface area 2*c* onto the third tapered surface 3*c*. In the below-described approached state 3*css* of the mantle liner 3, the length $L_1$ of the first area 11 at the inlet is greater than T and the length $L_2$ of the second area 12 at the inlet is greater than 0.5T.

Figure 3:
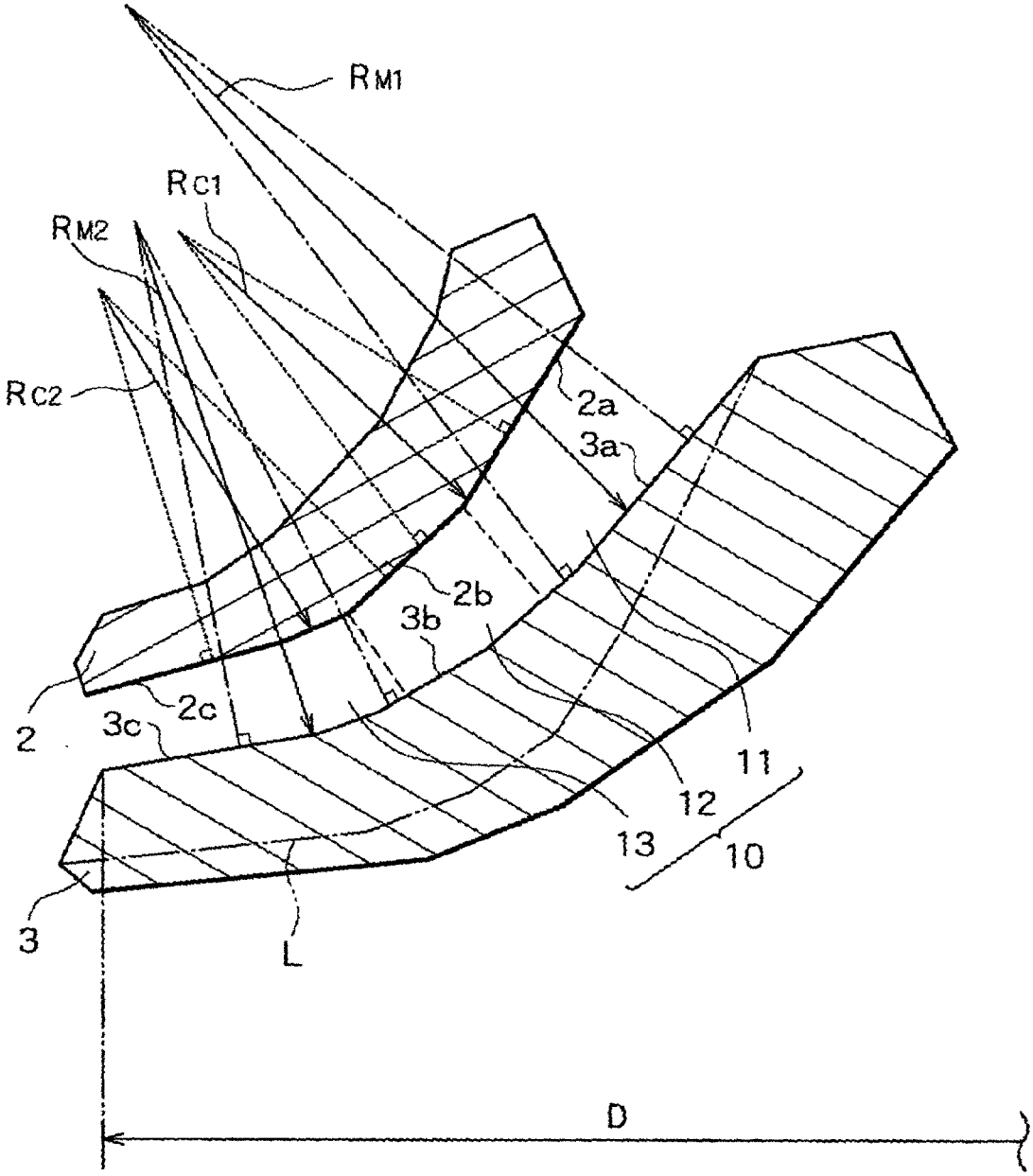
FIG. 3 is another sectional view of the concave liner section and the mantle liner section in FIG. 1.

Moreover, as shown in FIG. 3, an area in the vicinity of the above-described inflection point between the first area surface 2*a* and the second area surface 2*b* is formed in a curvature $R_{C1}$ of 1.4T to 1.7T as a center at which the perpendicular direction of the first area surface $C_1$ coincide with the perpendicular direction of the second area surface $C_2$, and an area in the vicinity of the inflection point between the second area surface 2*b* and the third area surface 2*c* is formed in a curvature $R_{C2}$ of 6.4T to 9.7T as a center at which the perpendicular direction of the second area surface $C_2$ coincide with the perpendicular direction of the third area surface $C_3$. On the other hand, an area in the vicinity of the inflection point between the first tapered surface 3*a* and the second tapered surface 3*b* is formed in a curvature $R_{M1}$ of 1.7T to 2.0T as a center at which the perpendicular direction of the first tapered surface $M_1$ coincide with the perpendicular direction of the second tapered surface $M_2$, and an area in the vicinity of the inflection point between the second tapered surface 3*b* and the third tapered surface 3*c* is formed in a curvature $R_{M2}$ of 13T to 16.3T as a center at which the perpendicular direction of the second tapered surface $M_2$ coincide with the perpendicular direction of the third tapered surface $M_3$. Moreover, the mantle liner 3 wears away with time due to the crushing of the crush material 21 in the crushing chamber 10, and further when the inner surface of the mantle liner reaches the abrasion line L, the mantle liner has to be exchanged for a new mantle liner 3.

Figure 4:
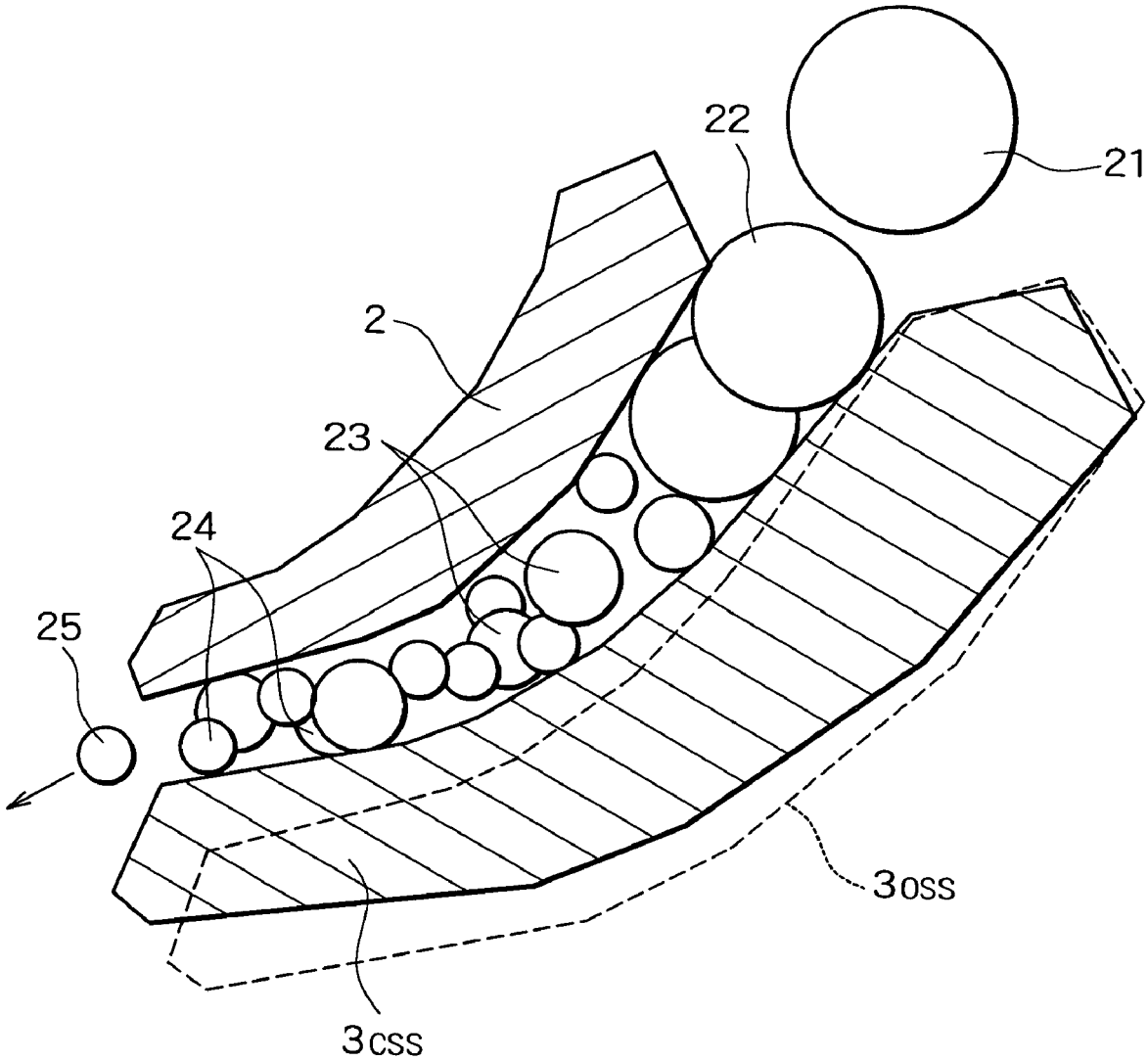
FIG. 4 is a sectional view of describing the operational state of the concave liner section and the mantle liner section in FIG. 1.

As shown in FIG. 4, the crush material 21 supplied into the crushing chamber 10 is crushed by repeating the alternation between the approach state 3*css* and the separate state 3*oss* of the mantle liner 3 relative to the fixed concave liner 2. The crush material supplied into the crushing chamber 10 changes into a crush material 22 in the first area 11, into a crush material 23 in the second area 12, and into a crush material 24 in the third area 13, and finally discharged as a product 25.

In the following, the function of the cone crusher 1 having the above-described structural arrangement will be described.

Firstly, in the initial stage of preparation, as shown in FIG. 1, the height of the concave liner 2 is adjusted in accordance with the nominal charging raw material size T for the crush material 21. When, for instance, the charging raw material size T for the crush material is larger, the width between the upper and lower liners 2 and 3 should be adjusted to be larger. In this case, when the counter shaft 5 is driven by the motor via a V-shaped belt, the eccentric driving mechanism 8 is rotated by the bevel gear 6. Accordingly, the main shaft 4 is rotated eccentrically in the state in which the upper end of the main shaft is supported by a bearing 9, and further the up/down movement thereof is performed by the piston 7.

In conjunction with the above, the mantle liner 3 fixed to the movable base 4*a* of the main shaft 4 is also rotated eccentrically together with the up/down movement. The swiveling motion of the mantle liner 3 allows the crush material to be crushed in the crushing chamber 10 formed between the upper and lower liners 2 and 3. The concave liner 2 and the mantle liner 3, i.e., the paired upper and lower liners for coming into contact with the crush material 21 and for compressing it to crush the material are made of a wear resistance material, and they are exchanged for new ones, when it is discerned that the abrasion arrives at a limit (abrasion line L in FIG. 3).

As shown in FIG. 4, the crush of the above crush material 21 is carried out sequentially through the first area 11 to the third area 13. The crush material 21 is crushed by the single particle compression in the first area 11 and then by compressing the particle layers both in the second area 12 and in the third area 13, and thereafter discharged as a product 25.

Figure 5:
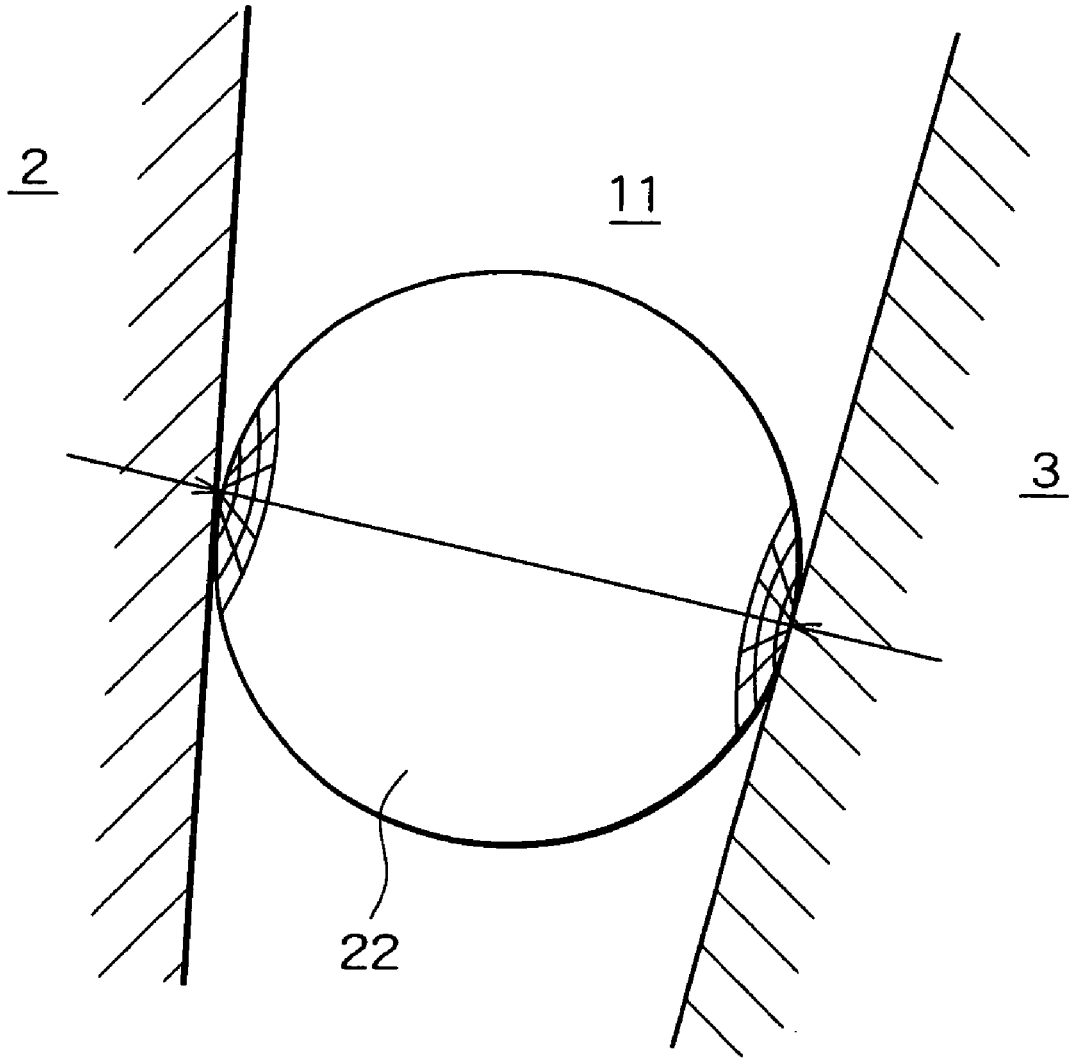
FIG. 5 is a sectional view of describing the crushing state of a material to be crushed.
Figure 6A:
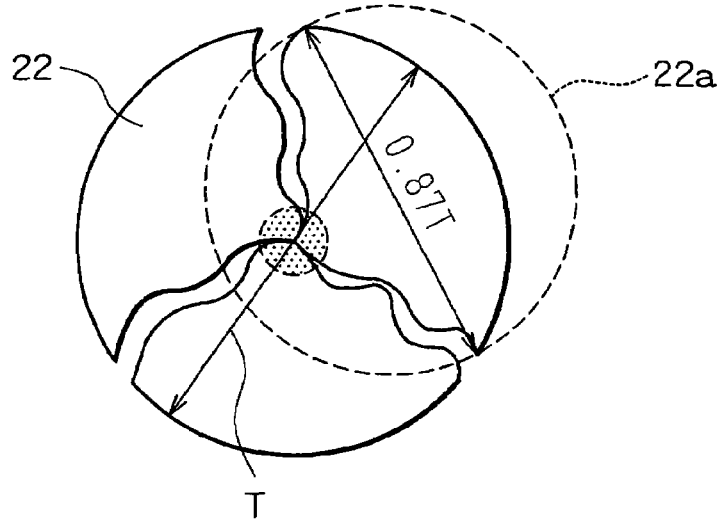
FIG. 6 shows sectional views of describing the crushing state of a material to be crushed, (a) first stage; (b) second stage; and (c) third stage.
Figure 6B:
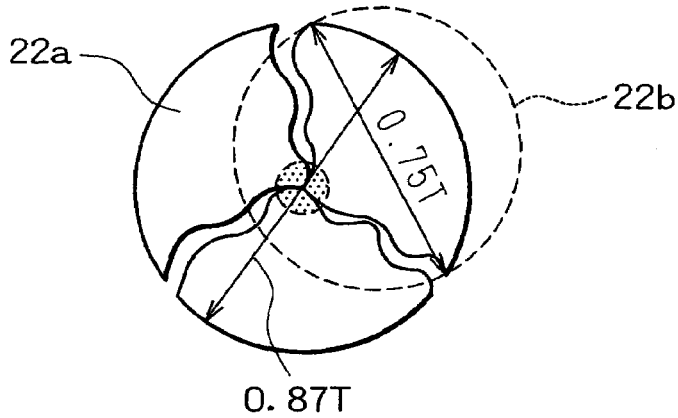
Figure 6C:
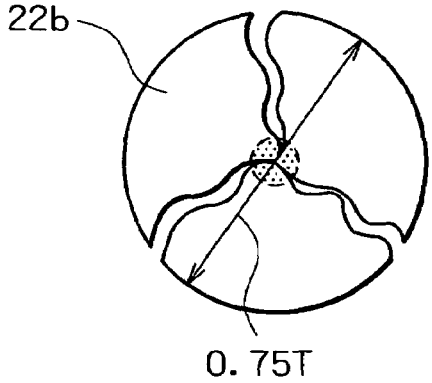

The above-described single particle compression crushing implies that the crush material 22 is directly received between the concave liner 2 and the mantle liner 3 and the crushing is carried out by means of the press force acting between the contact areas of the liners 2 and 3, as shown in FIG. 5. The single particle compression crushing is several times carried out in the first area 11. For instance, when the crush material 22 having a charging raw material size T is divided into three parts, as shown in FIG. 6(*a*), it changes into the crushed materials 22*a*, each having a charging material size of 0.87T. When, moreover, the crush material 22*a* having a charging material size 0.87T is divided into three parts, as shown in FIG. 6(*b*), it changes into the crushed materials 22*b*, each having a charging material size of 0.75T. The crushed material 22*b* having a charging material size of 0.75T is further divided into three parts, as shown in FIG. 6(*c*).

Figure 7:
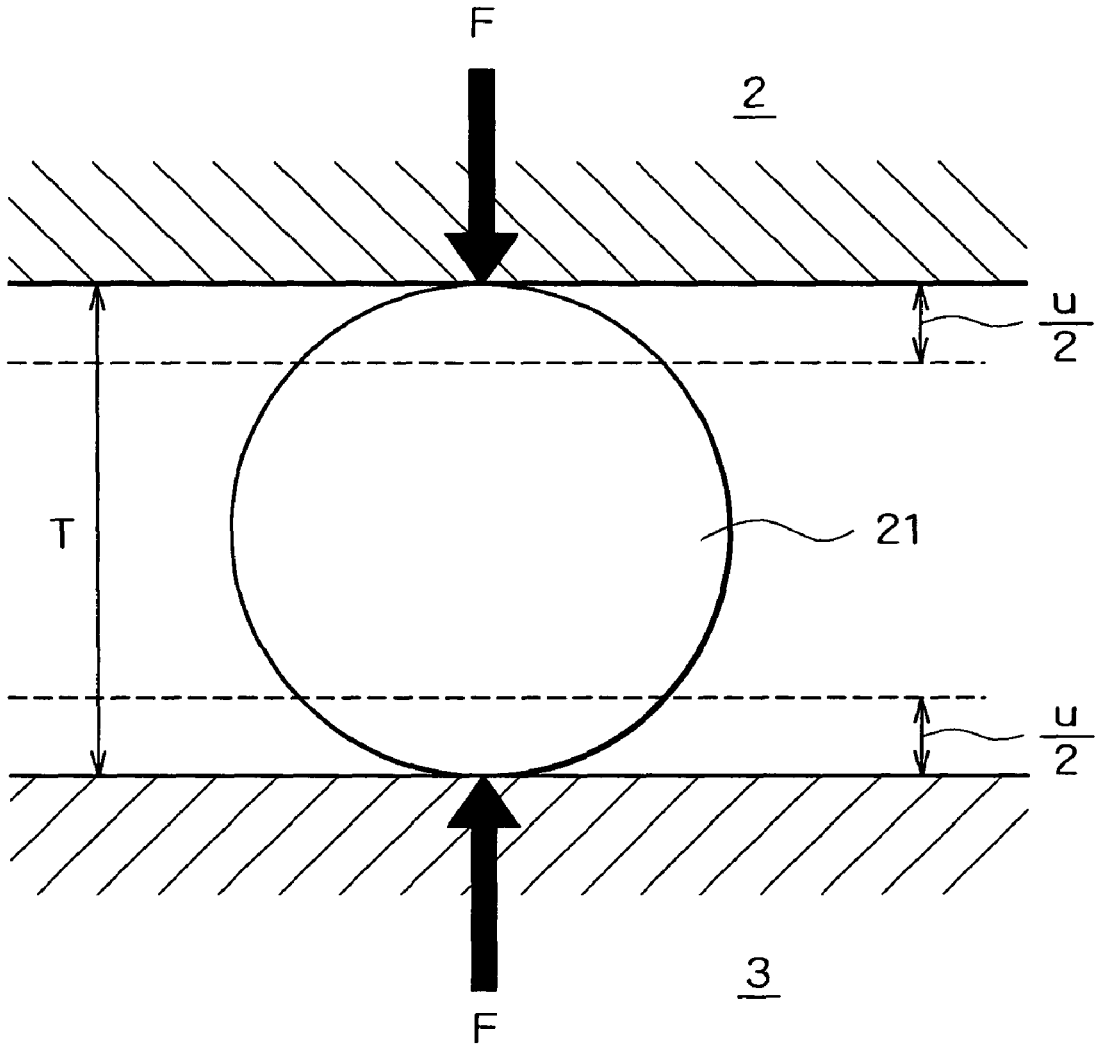
FIG. 7 is another sectional view of describing the crushing state of a material to be crushed.
Figure 8:
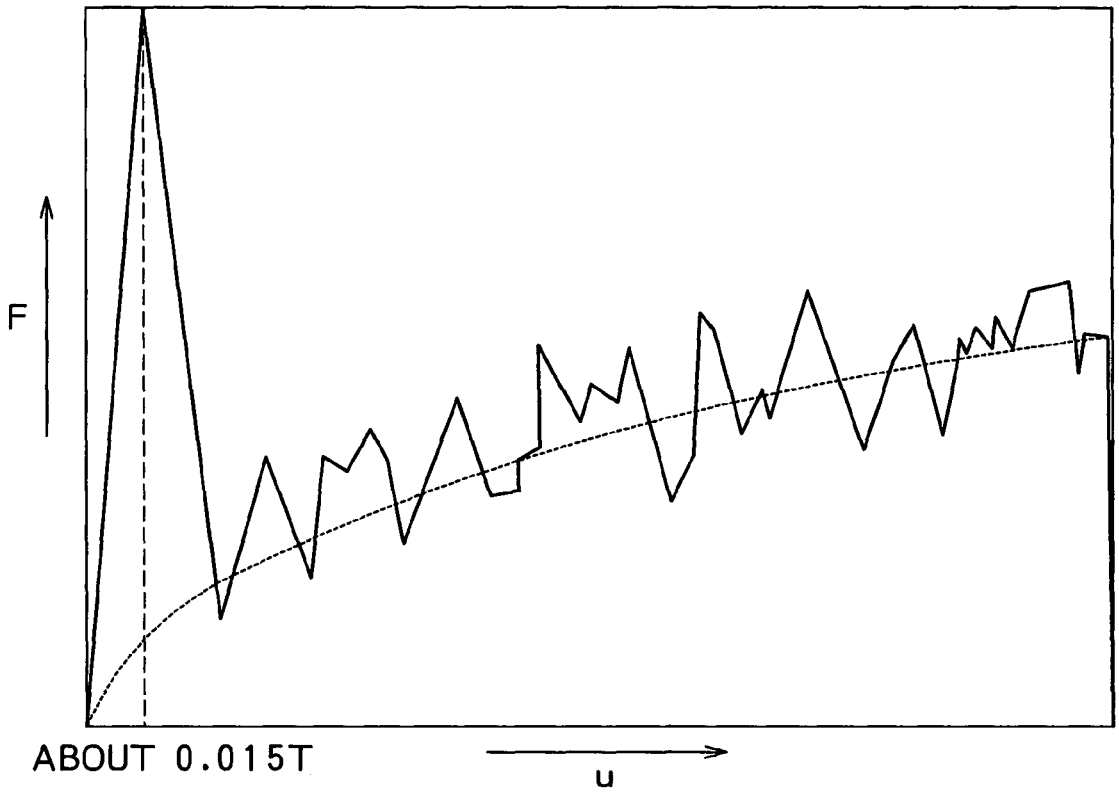
FIG. 8 is a diagram showing the change of the displacement of the crush material vs. an applied load.

In FIG. 7, when the crush material 21 having a charging raw material size T to be crushed by the single particle compression is received by the concave liner 2, and then receives a press force F at the contact points for the liners 2 and 3, the crush material 21 is displaced by u/2. More specifically, as shown in FIG. 8, the load F gradually increases with the increase of the displacement u, and the single particle is divided into several parts at a deformation of about 0.015T. A further increase in the displacement u provides the crushing state shown in FIG. 9.

Figure 9:
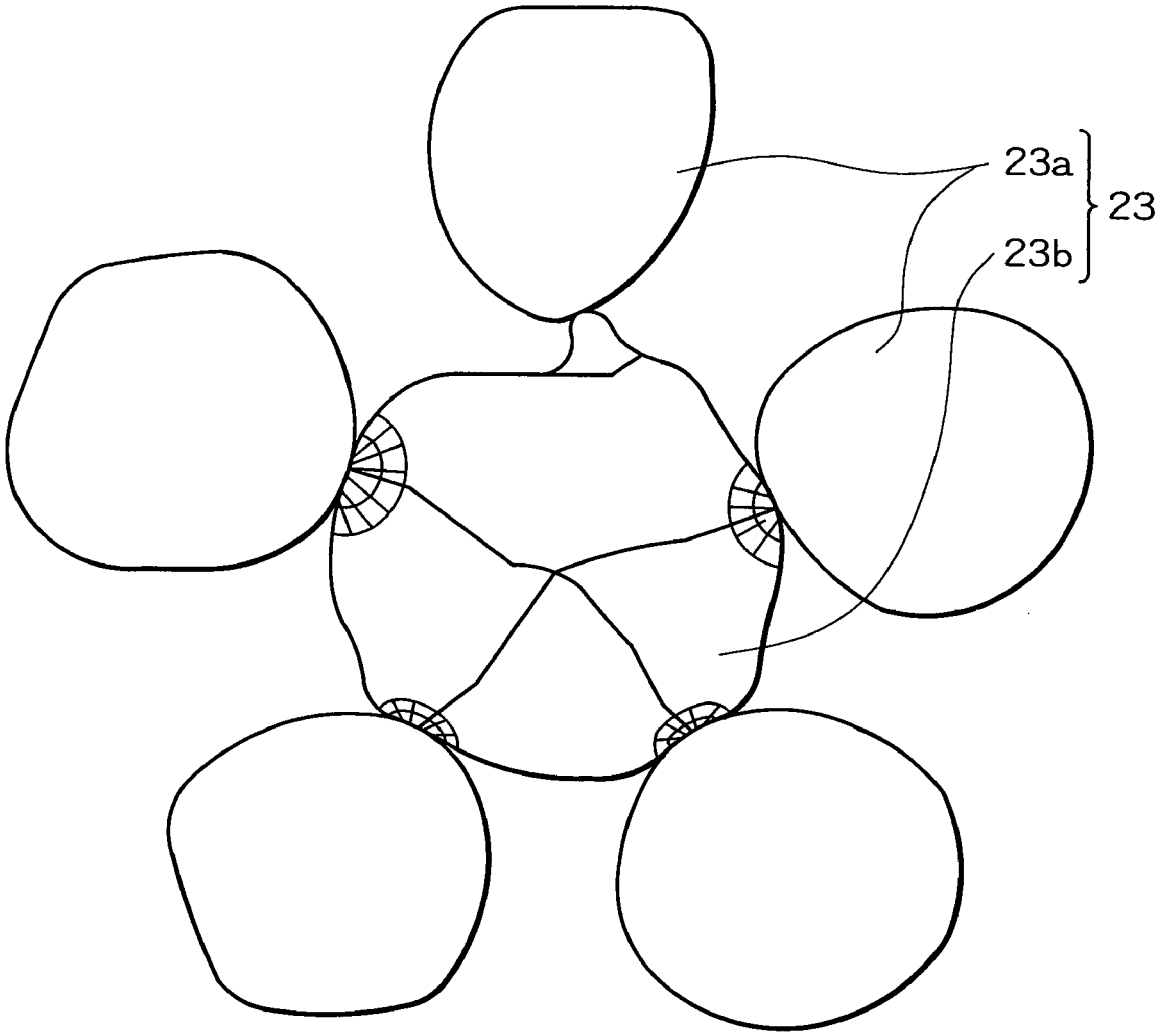
FIG. 9 is a sectional view of describing the crushing state of the crush material in the particle layer compression crushing.

The above-described particle layer compression crushing implies that, in the separate state 3*oss* of the mantle liner 3, as shown in FIG. 4, particles of the crush material 23 are stacked into the crushing chamber 10 in a laminar state and, in the approach state 3*css*, the air gap between the particles of the crush material 23 is reduced so that the particles are crushed by the multiple particle contact. As shown in FIG. 9, a crush particle 23*a* is crushed by the press forces at contact points with a plurality of contact particles 23*a*. Since fine crush particles 23 in the laminar state are crushed, as described above, the second area 12 can be regarded as a high crushing surface pressure area (high abrasion area). Moreover, the second area 12 adjacent to the second area 12 can also be regarded as a high crushing surface pressure area (high abrasion area).

As described above, the cone crusher 1 according to this embodiment comprises the stationary concave liner 2 and the mantle liner 3 fixed to the mounting base 4*a* as a movable element which approaches the inner periphery of the concave liner 2 and otherwise separates therefrom, whereby the crushing chamber 10, whose width gradually increases from the inlet 10*a* to the outlet 10*b*, is formed to crush the crush material 21 having a charging raw material size T between the concave liner 2 and the mantle liner 3.

For the cone crusher 1, it is required to provide a pair of upper and lower liners 2 and 3, which liners decrease uneven abrasion due to the crushing effect and enhance the throughput of products, maintaining a good fine-crushing performance. This is due to the following facts that, even if an optimal shape of the crush chamber is formed, taking these conditions into account, the selective abrasion takes place in the paired upper and lower liners forming the crushing chamber (partial abrasion) to partially generate an extremely uneven abrasion, so that the shape of the crushing chamber becomes extremely different from the originally designed shape (new liner) and therefore the crushing performance is rapidly reduced, and that when the crushing performance is reduced due to the uneven abrasion, the operation is paused and the worn liner is exchanged for a new liner, in which case, such uneven abrasion provides both extremely worn parts and relatively weak worn parts so that the exchange for a new liner is uneconomic.

In the embodiment, the concave liner 2 has a length $C_1$ of T to $\sqrt{2}$T, and it is provided with the first area surface 2*a* forming the first area 11 facing the crushing camber 10, the second area surface 2*b* forming the second area 12 facing the crushing chamber 10 and which surface is inclined toward the outside, and the third area surface 2*c* forming the third area 13 facing the crushing chamber 10 and which surface is further inclined toward the outside, in which case, the area surfaces 2*a* to 2*c* are continuously arranged in a curvilinear manner from the inlet 10*a* of the crushing chamber 10. Moreover, the mantle liner 3 is provided with the first tapered surface 3*a* having a length $L_1$ of the perpendicular from the first area surface 2*a* at the end on the inlet side being greater than T, a cross angle $\theta_1$ relative to the first area surface 2*a* being less than 20°, and an inclination angle $\alpha_1$ of greater than 60°; the second tapered surface 3*b* having a length $L_2$ of the perpendicular from the second area surface 2*b* at the end on the inlet side being greater than 0.5T and a cross angle $\theta_2$ relative to the second area surface 2*b* being 5° to 10°; and the third tapered surface 3*c* having an inclination angle $\alpha_3$ of 45° to 50°, in which case, the tapered surfaces 3*a* to 3*c* are continuously arranged in a curvilinear manner from the inlet 10*a* of the crushing chamber 10.

Since the length $L_1$ of the perpendicular from the first area surface 2*a* to the first tapered surface 3*a* in the first area 11 is greater than T, the crush material 21 having a charging raw material size T can be inserted thereto. When the nominal charging raw material size is T, the maximum particle size is $\sqrt{2}$T, so that the first area surface 2*a* has a length suitable for receiving the crush material 21 as a single particle.

Since, moreover, the cross angle $\theta_1$ between the first tapered surface 3*a* and the first area surface 2*a* is less than 20°, the crush material 21 can be well received by the first tapered surface 3*a* and the first area surface 2*a*. Furthermore, for the sake of restriction in the size of machine, it is desirable that the cross angle $\theta_1$ is 15° to 20°.

In addition, the crush material 21 can be transferred to the next stage (the second area 12), because the inclination angle $\alpha_1$ is greater than 60°. Accordingly, each particle in the crush material 21 having a charging raw material size T can be received directly by the concave liner 2 and the mantle liner 3 in the first area 11, so that the single particle compression crushing can be well carried out with aid of the press force between the liners 2 and 3.

Since the length $L_2$ of the perpendicular from the second area surface 2*b* to the second tapered surface 3*b* at the end of the inlet in the second area 12 is greater than 0.5T, the crush material 22 having a predetermined size can be sequentially introduced into the second area 12, after the single particle compression crushing is several times carried out in the first area 11.

Since, moreover, the cross angle $\theta_2$ between the second tapered surface 3*b* and the second area surface 2*b* is greater than 5°, a desirable size for the inlet of the second area 12 can be secured even when the concave liner 2 approaches the mantle liner 3. Since, furthermore, the cross angle $\theta_2$ is less than 10°, the volume of the space of the second area 12 can be set as small as possible, and the crush material 23 is securely received in the second area 12, thereby enabling the crushing to be carried out in high efficiency. As a result, the crush material 22 crushed down to a predetermined size in the first area 11 is packed into the second area 12 in the laminar manner, when the mantle liner 3 is away from the concave liner 2. Therefore, when changing from the separate state to the approach state, the spacing between the particles in the crush material 23 is decreased. This causes the particles to become into contact, so that the crushing starting at contact points between particles takes place due to the compression of particle layers.

In conjunction with the above, it is desirable that the inclination angle $\alpha_2$ of the second tapered surface 3*b* is 47° to 57°. This is due to the fact that the second tapered surface 3*b* is inclined toward the outside of the first tapered surface 3*a* and it is inclined more gently than the third tapered surface 3*c*, as will be later described. Moreover, in order to smoothen the change in the inclination angle from the first tapered surface 3*a* to the second tapered surface 3*b*, it is desirable that the inclination angle $\alpha_2$ is 52° to 57°.

In the third area 13, the crushing due to the particle layer compression follows that in the second area 12. Since the inclination angle $\alpha_3$ of the third tapered surface 3*c* is 45° to 50°, the crush material 24 moves at an optimum final traveling speed in the third area 13. As a result, in the vicinity of the outlet at which the crushed material 24 is discharged from the crushing chamber 10, a greater amount of crushed particles at a high packaging density can be discharged as a high quality product without clogging up the particle flow.

Hence, in the crushing chamber 10, a pair of upper and lower liners 2 and 3 can be manufactured, in which uneven abrasion resulting from the crushing effect is suppressed, and in which the throughput of products is enhanced, maintaining a stable and good fine-crushing performance in a desired particle size.

In the embodiment, the third tapered surface 3*c* has a cross angle $\theta_3$ of 2° to 3° with respect to the third area surface 2*c*, thereby making it possible to suppress the fracture of the end portion of the outlet 10*b* for the crush material 24 due to the generation of an excess stress and the local abrasion of thereof.

In the embodiment, moreover, the second area surface 2*b* has a length $C_2$ of T to $\sqrt{2}$T, and the third area surface 2*c* has a length $C_3$ of T/$\sqrt{2}$ to T. As a result, the size of the crush material more rapidly arrives at a desirable particle size of product. In this case, it is desirable that the length $C_3$ is set to be 0.85T to T.

In the embodiment, moreover, the first tapered surface 3*a* has a length $M_1$ of T/$\sqrt{2}$ to T. The minimum size of the charging raw material in the crush material 21, which is crushed in the cone crusher 1, is assumed to be T/$\sqrt{2}$ or so. As a result, since the mantle liner 3 is also regarded as a movable element, the crush material may be treated and crushed as single particles in the first area 11. Since, moreover, the cross angle $\theta_1$ should be preferably at 15° to 20°, as described above, the subtraction of an effective length from the length of the first tapered surface provides $T/\sqrt{2}-(T/\sqrt{2})/2 \tan\{\tan^{-1}(2\times\tan 20°)\}\cong 0.45T$ and $T-T/2 \tan\{\tan^{-1}(2\times\tan 15°)\}\cong 0.73T$. Therefore, the length $M_1$ should be preferably 0.45T to 0.73T, and further it should be more preferably about 0.6T to 0.75T, taking the safety into account.

In the embodiment, moreover, the second tapered surface 3*b* has a length $M_2$ of $\sqrt{2}T$ to 2.4T, thereby making it possible to make the abrasion of the mantle liner 3 uniform over the second area 12 in which a high crushing surface pressure is generated.

This is due to the fact that, if neglecting the size of the outlet lob in the third area 13, from the lengths $C_1$, $C_2$ and $C_3$ of the concave 2 and the lengths $M_1$ and $M_3$ of the mantle liner 3, where the lengths $C_3$ and $M_3$ will be later described, it follows that the length $M_2$ becomes greater than $\sqrt{2}T$, and that since (the maximum height of the concave liner)−(the minimum height of the mantle)>0, the length $M_2$ becomes $\{(1.4T+1.2T \sin 62°+T \sin 52°)-(0.7T \sin 70°+M_2 \sin 52°+T \sin 45°)\}>0$, and therefore it leads to the maximum length $M_2\cong 2.4T$.

If, moreover, the length $M_2$ is estimated from the width between the paired upper and lower liners 2 and 3, (the maximum length $M_2$)−(the minimum length $C_2$)>T leads to $(0.75T \cos 70°+M_2 \cos 52°+1.2T \cos 45°)-(T \cos 62°+0.85T \cos 52°)>T$ and thus $M_2>1.44T$.

Moreover, since (the maximum length $M_2$)−(the maximum length $C_2$)<T, it leads to $(0.75T \cos 70°+M_2 \cos 52°+1.2T \cos 45°)-(1.2T \cos 57°+T \cos 47°)<T$ and therefore $M_2<2.0T$.

In view of the above, it is desirable that the length $M_2$ of the second tapered surface 3*b* should be set 1.44T to 2.0T.

Since, moreover, the dimension D of the mantle liner 3 having a charging raw material size T for the crush material 21 is 0.15 to 0.19, it is represented such that T=0.15D to 0.19D (D=5.3T to 6.5T). Since approximately one third of the dimension D of the mantle liner 3 is required for the diameter of the main shaft 4 from the viewpoint of the mechanical strength, this leads to $1.2T \cos 45°+M_2 \cos 52°+0.75T \cos 70°>0.35T$. As a result, $M_2>1.218$ in the case of D=5.3T, and $M_2>1.9$ in the case of D=6.5T. Furthermore, it follows that $T \cos 50°+M_2 \cos 57°+0.6T \cos 75°<0$. As a result, $M_2<1.94$ in the case of D=5.3T, and $M_2<2.71$ in the case of D=6.5T. Hence, it is desirable that the length $M_2$ should be set 1.45T to 1.9T, and further in order to securely obtain a desirable affect with a more largely increased length, the length $M_2$ should be set preferably 1.7T to 1.9T In the embodiment, moreover, the third tapered surface 3*c* has a length $M_3$ of T to $\sqrt{2}T$, thereby making possible to make the abrasion of the mantle liner 3 uniform over the third area 13 in which a high crush surface pressure is generated. In this case, it is desirable that $M_3$ should be set T to 1.2T.

In the embodiment, moreover, the curvature $R_{C1}$ between the first area surface 2*a* and the second area surface 2*b* is 1.4T to 1.7T. As a result, it is possible to make the abrasion of the concave liner 2 uniform over the crushing surface pressure-increasing area, where the single particle compression crushing in the first area 11 changes to the particle layer compression crushing in the second area 12.

In the embodiment, moreover, the curvature $R_{C2}$ between the first area surface 2*a* and the third area surface 2*b* is 6.4T to 9.7T. As a result, it is possible to make the abrasion of the concave liner 2 uniform from the second area 12 to the third area 13, where the particle layer compression crushing takes place. This is due to the fact that, if the length $C_2$ is 1.2T to T and the length $C_3$ is 0.85T to T, $R_{C2} \tan\{(62°-47°)/2\}=0.85T$ so that $R_{C2}=6.456T$, and further $R_{C2} \tan\{(57°-47°)/2\}=0.85T$ so that $R_{C2}=9.72T$, when taking into account the inclination angle between the second area surface 2*b* and the third area surface 2*c*.

In the embodiment, moreover, the curvature $R_{M1}$ between the first tapered surface 3*a* and the second tapered surface 3*b* is 1.7T to 2.0T. As a result, it is possible to make the abrasion due to the crushing uniform in an area where the single particle compression crushing is transferred to the particle layer compression crushing. This is due to the fact that, when taking into account the inclination angles of the first area surface 2*a*, the second area surface 2*b*, the first tapered surface 3*a* and the second tapered surface 3*b*, $R_{M1}=1.74T$ is derived from the relation $R_{M1} \tan(90°-52°)/2=0.6T$, and $R_{M1}=2.206T$ is derived from the relation $R_{M1} \tan(90-57°)/2=0.6T$.

Moreover, the curvature $R_{M2}$ between the second tapered surface 3*b* and the third tapered surface 3*c* is 13T to 16.3T. As a result, it is possible to make the abrasion of the mantle liner 3 uniform from the second area 12 to the third area 13, where the particle layer compression crushing takes place. This is due to the fact that, when taking into account the inclination angles of the second area surface 2*b*, the third area surface 2*c*, the second tapered surface 3*b* and the third tapered surface 3*c*, $R_{M1}=9.514T$ is derived from the relation $R_{M2} \tan(57°-45°)/2=T$, and $R_{M2}=16.3T$ is derived from the relation $R_{M2} \tan(57°-45°)/2=T$. Moreover, in order to obtain further smooth abrasion, it is preferable that the curvature $R_{M2}$ is 13T to 16.3T.

In the above embodiment, the cone crusher 1 is described, in which the length $C_1$ of the first area surface 2*a* is specified under the condition that the charging raw material size is T. However, the present invention is not restricted to such a structural arrangement. That is, in another embodiment, under the condition that any charging raw material size is not specified, a crushing chamber 10 comprises a first area 11 in which the crushing surface of a mantle liner 3 at the inlet for crushing material 21 is 70° to 75° to the horizontal plane and the angle between the crushing surface of a concave liner 2 and the first area 11 is 15° to 20°; a second area 12 in which the crushing surface of the mantle liner 3 at a middle section between the inlet and the outlet for the crushing material is 52° to 57° to the horizontal plane and the angle between the concave liner 2 and the crushing surface is 5° to 10°; and a third area 13 in which the crushing surface of the mantle liner 3 at the outlet is 45° to 50° to the horizontal plane and the angle between the concave liner 2 and the crushing surface is 2° to 3°; and wherein these areas 11 to 13 can be sequentially arranged in a curvilinear manner.

Since, therefore, the cross angle between the crushing surface of the concave liner 2 and the crushing surface of the mantle liner 3 is less than 20° in the first area 11, the crush material can be well received. Since, moreover, the inclination angle of the crushing surface of the mantle liner 3 is greater than 70°, the crush material can be securely supplied to the next stage (the second area). As a result, each particle in the crush material is directly received between the concave liner 2 and the mantle liner 3 in the first area 11, so that the single particle compression crushing is well carried out by the press force of these liners 2 and 3.

Since, moreover, the cross angle between the crushing surface of the concave liner 2 and the crushing surface of the mantle liner 3 is greater than 5° in the second area 12, an appropriate dimension of the inlet in the second area 12 may be maintained, even when the mantle liner 3 approaches the concave liner 2. Since, furthermore, the cross angle is less than 10°, the crush material is securely received therebetween and effectively crushed. In conjunction with the above, since the inclination angle of the crushing surface of the mantle liner 3 is greater than 52°, the crush material can be securely supplied to the next stage (the third area). Accordingly, the crush material, which is crushed into a predetermined particle size in the first area 11, is stacked in the form of layers into the second area 12, when the mantle liner 3 is away from the concave liner 2. Furthermore, when changing from the separate state to the approach state, the space factor between particles in the crush material is reduced and therefore the multiple particle contact takes place, thereby causing the particle layer compression crushing to be carried out, where the particles are fractured at contact points between particles.

In the third area 13, moreover, the particle layer compression crushing takes place, following that in the second area 12, and therefore the inclination angle of the crushing surface of the mantle liner 3 is 45° to 50°. Hence, the crush material may be moved at an optimal final traveling speed in the third area 13. As a result, in the vicinity of the outlet at which the crushed material is discharged from the crushing chamber 10, a greater amount of crushed particles at a high packaging density can be discharged as a high quality product without clogging up the particle flow.

Hence, even if the charging raw material size is not specified, a pair of upper and lower liners each having a specific shape can be realized, wherein uneven abrasion due to the crushing action in the crushing chamber 10 may be greatly reduced, and at the same time the throughput of products may be enhanced, maintaining a stable and good fine-crushing performance in a desired particle size.

In the above structural arrangement, moreover, the crushing surface of the concave liner 2 is approximately 90° in the first area 11, 57° to 62° in the second area 12, and 47° to 52° in the third area 13, to the horizontal plane. In this case, the crush material can securely be supplied to the next stage (the second area), because the crushing surface of the concave liner 2 is approximately 90°. Moreover, the crushing surface of the concave liner 2 is 57° to 62° in the second area 12, so that an appropriate dimension of the inlet in the second area may be maintained even when the mantle liner 3 approaches the concave liner 2. In conjunction with the above, the inclination angle of the crushing surface in the mantle liner 3 is greater than 52°, thereby enabling the crush material to be securely supplied to the next stage (the third area). Furthermore, the crushing surface of the concave liner 2 is 47° to 52° in the third area 13, so that the particle layer compression crushing takes place, following that in the second area 12.

As an example, employing a cone crusher 1 according to the first embodiment, the crush material 21 was crushed till the surface of the mantle liner 2 reached the abrasion line L shown in FIG. 3. An investigation was made as for the crushing performance, such as the throughput of products, the electric power consumption, the fine-crushing performance and the like, from the start of crushing to the state in which the liner surface arrives at the abrasion line L.

In the example, the throughput of products was enhanced, while maintaining a good fine-crushing performance for the crush material 21, i.e., such a crushing ratio of 4.8 to 5.5 as obtained with the new original components, compared with the result obtained with the conventional components. Moreover, the concave liner 2 and the mantle liner 3 were uniformly worn away without any uneven abrasion till the surface of the latter arrived at the abrasion line L, and therefore the service life of the liners 2 and 3 was increased by a factor of about 1.2. In addition, the crush material 21 was smoothly crushed without clogging up between the paired upper and lower liners 2 and 3, so that the electric power consumption was reduced.

What is claimed is:

1. A cone crusher comprising:

a stationary liner, wherein a substantially vertical axis passes through the stationary liner;

a mounting base as a movable element which is movable about the substantially vertical axis, wherein the mounting base is capable of approaching an inner periphery of said stationary liner and separating therefrom; and a mantle liner fixed to said mounting base and positioned relative to said stationary liner to form a crushing chamber therebetween, said crushing chamber having an inlet and an outlet, wherein a crush material is sequentially crushed in first, second and third portions of the crushing chamber, thereby defining a direction of movement of said crush material from said inlet of said crushing chamber to said outlet of said crushing chamber, wherein said liner comprises:

a first area surface at said first portion of said crushing chamber and having a length of T to $\sqrt{2}T$ in the direction of movement of the crush material from the inlet of said crushing chamber to the outlet thereof, said first area surface facing said crushing chamber, wherein T is a predetermined value;

a second area surface facing said crushing chamber at said second portion of said crushing chamber; and a third area surface facing said crushing chamber at said third portion of said crushing chamber, whereby said first to third area surfaces are sequentially arranged in the direction of movement of the crush material from the inlet of said crushing chamber to an outlet thereof, and wherein said mantle liner comprises:

a first tapered surface, wherein a length of a perpendicular line from said first area surface to said first tapered surface at a side of said first portion of said crushing chamber closest to said inlet is greater than T, a cross angle of said first tapered surface is less than 20° with respect to said first area surface, and an inclination angle of said first tapered surface is greater than 60° relative to a horizontal plane;

a second tapered surface, wherein a length of a perpendicular line from said second area surface to said second tapered surface at a side of said second portion of said crushing chamber closest to said inlet is greater than 0.5T and a cross angle of said second tapered surface is 5° to 10° with respect to said second area surface; and a third tapered surface having an inclination angle of 45° to 50° relative to the horizontal plane;

whereby said first to third tapered surfaces are sequentially arranged from the inlet of said crushing chamber in the direction of movement.

2. The cone crusher according to claim 1, wherein said third tapered surface has a cross angle of 2° to 3° with respect to said third area surface.

3. The cone crusher according to claim 1, wherein said second area surface has a length in the direction of movement of T to $\sqrt{2}$T and said third area surface has a length in the direction of movement of T/$\sqrt{2}$ to T.

4. The cone crusher according to claim 1, wherein said first tapered surface has a length in the direction of movement of T/$\sqrt{2}$ to T.

5. The cone crusher according to claim 1, wherein said second tapered surface has a length in the direction of movement of $\sqrt{2}$T to 2.4T.

6. The cone crusher according to claim 1, wherein said third tapered surface has a length in the direction of movement of T to $\sqrt{2}$T.

7. The cone crusher according to claim 1, wherein the curvature radius in a portion of the stationary liner between said first area surface and said second area surface is 1.4T to 1.7T.

8. The cone crusher according to claim 1, wherein the curvature radius in a portion of the stationary liner between said second area surface and said third area surface is 6.4T to 9.7T.

9. The cone crusher according to claim 1, wherein the curvature radius in a portion of the mantle liner between said first tapered surface and said second tapered surface is 1.7T to 2.0T.

10. The cone crusher according to claim 1, wherein the curvature radius in a portion of the mantle liner between said second tapered surface and said third tapered surface is 13T to 16.3T.

11. A cone crusher comprising:

a stationary liner, wherein a substantially vertical axis passes through the stationary liner;

a mounting base as a movable element which is movable about the substantially vertical axis and is capable of approaching an inner periphery of said stationary liner and separating therefrom; and a mantle liner fixed to said mounting base and positioned relative to said stationary liner to form a crushing chamber therebetween, wherein the crushing chamber has an inlet and an outlet, and the crush material moves from said inlet to said outlet, thereby defining a direction of movement of said crush material from said inlet of said crushing chamber to said outlet of said crushing chamber, wherein a crush material is crushed in the crushing chamber, wherein said crushing chamber comprises:

a first portion defined by said stationary liner and said mantle liner, wherein a crushing surface of said mantle liner at an inlet for the crush material is 70° to 75° to the horizontal plane and the angle between a crushing surface of said stationary liner and the crushing surface of said mantle liner at the inlet is 15° to 20°;

a second portion of said crushing chamber defined by said stationary liner and said mantle liner, wherein the crushing surface of said mantle liner at a middle part between the inlet and the outlet for the crush material is 52° to 57° to a horizontal plane and the angle between the crushing surface of said liner and the crushing surface of said mantle liner at the middle part is 5° to 10°; and a third portion of said crushing chamber defined by said stationary liner and said mantle liner, wherein the crushing surface of said mantle liner at the outlet for the crush material is 45° to 50° to the horizontal plane and the angle between the crushing surface of said stationary liner and the crushing surface of said mantle liner at the outlet is 2° to 3°;

whereby said first to third portions of said crushing chamber are sequentially arranged in the direction of movement of the crush material from the inlet to the outlet.

12. The cone crusher according to claim 11, wherein the crushing surface of said stationary liner is approximately 90° in said first area, 57° to 62° in said second area, and 47° to 52° in said third area, to the horizontal plane.

* * * * *